US007758323B2

(12) United States Patent
Orue

(10) Patent No.: US 7,758,323 B2
(45) Date of Patent: Jul. 20, 2010

(54) DRAIN PUMP FOR HOME APPLIANCES

(75) Inventor: Rodrigo Orue, Vitoria (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 972 days.

(21) Appl. No.: 11/524,930

(22) Filed: Sep. 21, 2006

(65) Prior Publication Data

US 2007/0071617 A1 Mar. 29, 2007

(30) Foreign Application Priority Data

Sep. 23, 2005 (EP) ..... 05380207

(51) Int. Cl.
*F04B 35/04* (2006.01)

(52) U.S. Cl. ..... 417/423.7; 417/423.3; 417/423.15; 415/140

(58) Field of Classification Search ..... 417/423.1, 417/423.7, 423.15, 423.3; 415/131, 140
See application file for complete search history.

(56) References Cited

U.S. PATENT DOCUMENTS 2,824,520 A * 2/1958 Bartels ..... 417/423.7
3,330,529 A * 7/1967 Hansson ..... 251/149.6
4,964,783 A * 10/1990 Haverkamp ..... 415/52.1
7,334,543 B2 * 2/2008 Pawellek ..... 123/41.1

FOREIGN PATENT DOCUMENTS

| | | | |
|---|---|---|---|
| DE | 2510787 | A1 | 9/1976 |
| DE | 3715285 | A1 | 11/1988 |
| DE | 19546967 | A1 | 6/1997 |
| EP | 1162300 | A2 | 12/2001 |
| ES | 2142714 | B1 | 4/2000 |

* cited by examiner

*Primary Examiner*—Devon Kramer
*Assistant Examiner*—Peter J Bertheaud
(74) *Attorney, Agent, or Firm*—James E. Howard; Andre Pallapies

(57) ABSTRACT

A drain pump for home appliances that includes a motor with a turning shaft, an impeller connected to the turning shaft, and a hydraulic body in which the impeller is housed, the hydraulic body having an inlet conduit and an outlet conduit. The motor includes an actuator to block one of the conduits when the motor is not being powered, the motor itself performing the function of the anti-return valve.

19 Claims, 3 Drawing Sheets

DRAIN PUMP FOR HOME APPLIANCES

BACKGROUND OF THE INVENTION

The present invention relates to drain pumps for home appliances, in particular for washing machines, dryers and dishwashers.

Drain pumps for home appliances such as washing machines, dryers and dishwashers comprise a motor with a turning shaft, an impeller connected to said turning shaft and a hydraulic body in which said impeller is housed. Said hydraulic body has an inlet conduit from which the waste water from the washing chamber of the home appliance accesses the drain pump, and an outlet conduit from which said waste water is removed to the drain conduit.

In drain pumps the waste water must be prevented from returning in the opposite direction, passing from the drain conduit to the washing chamber of the home appliance, for which purpose anti-return valves are used.

ES 2142714 B1 discloses a water removing system in a washing machine that includes a drain pump that comprises in the outlet conduit a flap valve to perform the anti-return function. Said flap valve is opened when the water flows towards the drain conduit, but is closed by the action of the waste water itself when said water flows in the opposite direction. DE 3715285 A1, DE 19546967 A1 and EP 1162300 A2 disclose other examples of drain pumps with anti-return valves that are closed by the action of the waste water.

This type of anti-return valve has the drawback of offering no protection against the Venturi effect. Due to the Venturi effect, the passage of the water through the main conduit of the drain pump may cause the suction of the water from the washing chamber of the home appliance, with the anti-return valve not posing any resistance whatsoever to said suction. This means that additional elements must be used to prevent the Venturi effect, for example a siphon trap in the drain installation.

The drawback with these anti-return valves is that they tend to create priming problems in the drain pump, as they can lead to air accumulating inside the hydraulic body of the drain pump, thereby preventing in some cases said drain pump from functioning normally.

Said priming problems are also created in the drain installation. Siphon traps that usually has said installation to prevent the Venturi effect, prevent the passage of waste water thereby creating head loss leading to the accumulation of air.

For other applications, different from drain pumps for home appliances, pumps have been used that comprise a motor comprising actuating means to block one of said conduits when said motor is not being powered, the motor itself performing the function of a shut off valve.

DE 2510787 A1 discloses a circulating pump for central heating that comprises an impeller formed to act as shut off valve when the pump stops. Said pump comprises a motor with a turning shaft, said motor comprising a fixed stator and a rotor linked to said turning shaft, the impeller being connected to said turning shaft. When the motor is not being powered, said impeller acts as shut off valve. When said motor is powered, the magnetic field created by the stator moves the turning shaft axially and the impeller stops acting as shut off valve.

However, the pump of DE 2510787 A1 is, as stated before, for heating systems. In any event, it would be difficult to use a pump with the referred features as drain pump for home appliances, because a greater dimensioning of the stator of the motor is necessary in order to create a magnetic field able to move the turning shaft axially. A considerable increase of the size of the motor of the pump is a serious drawback for drain pumps for home appliances. Moreover, particularly if a permanent-magnet synchronous motor was used, apart from the size increase, there would be an important increase of energy consumption and costs.

BRIEF SUMMARY OF THE INVENTION

It is an object of the invention to provide a drain pump in which the waste water is prevented from returning to the washing chamber of the home appliance and which does not have the problems deriving from the use of an anti-return valve that is opened and closed by the action of the waste water.

The inventive drain pump comprises a motor with a turning shaft, an impeller connected to said turning shaft, and a hydraulic body in which said impeller is housed, said hydraulic body comprising an inlet conduit and an outlet conduit. The motor comprises actuating means to block one of said conduits when said motor is not being powered, the motor itself performing the anti-return valve function.

The actuating means axially move the turning shaft along with the impeller when there is no power running to the motor, said impeller blocking the inlet conduit. Said actuating means comprise a fixed part and a moving part to which the turning shaft is connected, a magnetic field being generated that keeps said fixed part and said moving part connected or next to each other when there is electrical power, and the motor also comprising recovery means that separate the fixed part and the moving part when there is no electrical power, axially moving the turning shaft.

The actuating means also comprise an auxiliary stator with an auxiliary winding, and the fixed part and the moving part of the actuating means operate as magnetic nuclei, the auxiliary winding generating the magnetic field that keeps the moving part connected or next to the fixed part.

With the inventive drain pump, the home appliance is protected from the Venturi effect, due to the fact that when it is not performing the drain function and the motor of the drain pump is not, therefore, being powered, the waste water is prevented from accessing the washing chamber of the home appliance, as either the inlet conduit or the outlet conduit of the hydraulic body remain closed and cannot be opened by the action of the water in either of the two flow directions. As a consequence, the use of siphon traps in the drain conduit is unnecessary. Thus, the problem of priming is also prevented as the air has an unobstructed exit route, i.e. there is no head loss.

Furthermore, the inventive drain pump, as the motor incorporates the drain function, provides a compact solution. Besides, as it is an auxiliary winding which generates the magnetic field that moves the turning shaft axially, it is not necessary to give to the stator of the motor a greater dimensioning in order to move said turning shaft.

These and other advantages and characteristics of the invention will be made evident in the light of the drawings and the detailed description thereof.

DETAILED DESCRIPTION OF THE INVENTION

Figure 1:
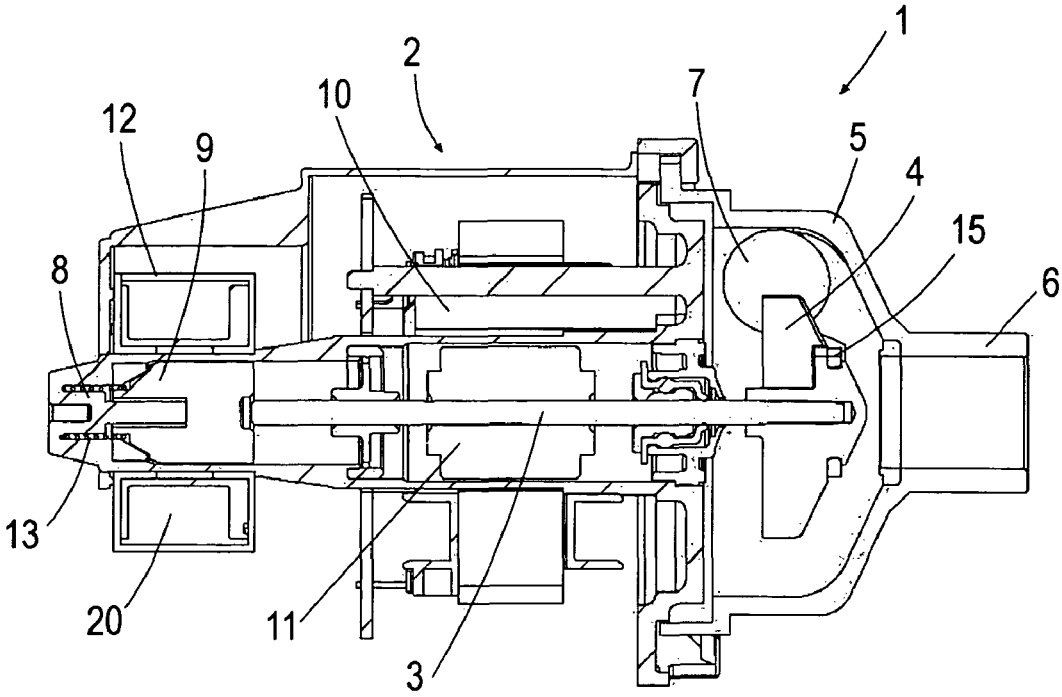
FIG. 1 is a view in section of a first embodiment of the invention with the inlet conduit open.

As the embodiments shown in FIGS. 1 to 4 reveal, the inventive drain pump 1 comprises a motor 2 with a turning shaft 3, an impeller 4 connected to said turning shaft 3, and a hydraulic body 5 in which said impeller 4 is housed. The hydraulic body 5 comprises an inlet conduit 6 which is accessed by the waste water that arrives from the washing chamber of the home appliance, and an outlet conduit 7 from which said waste water is removed to the drain conduit.

In the two embodiments shown, the motor 2 comprises actuating means to block the inlet conduit 6 when the motor 2 is not being powered and when, therefore, the drain function is not being performed. As a consequence, the motor 2 itself performs the anti-return valve function. When there is no power running to the motor, the blocking means axially move the turning shaft 3 along with the impeller 4, with said impeller 4 blocking the inlet conduit 6 moving, for example, for the first of the embodiments shown (see FIGS. 1 and 2), from the situation in FIG. 1 to the situation in FIG. 2.

As can be seen in said first embodiment, the actuating means comprise a fixed part 8 and a moving part 9. When there is electrical power a magnetic field is generated that keeps said fixed part 8 and said moving part 9 next to each other, with the impeller 4 remaining separate from the inlet conduit 6, as shown in FIG. 1. However, when there is no electrical power and said magnetic field disappears, recovery means make the moving part 9 separate from the fixed part 8, said moving part 9 axially moving the turning shaft 3 and with the impeller 4 blocking the inlet conduit 6, as shown in FIG. 2.

In the embodiments shown, the motor 2 is a permanent-magnet synchronous motor that comprises a fixed stator 10 and a rotor 11 linked to the turning shaft 3, the magnetic field created by said stator 10 producing the rotation of the turning shaft 3. Moreover, the actuating means comprise an auxiliary stator 12 with an auxiliary winding 20. The lines of the magnetic field created by the currents that circulate in the auxiliary winding 20 are closed by the fixed part 8 and the moving part 9, said two parts 8 and 9 operating as magnetic nuclei forming part of the magnetic circuit. This forces the moving part 9 to be attracted to the fixed part 8. Thus, it is the magnetic field generated in the auxiliary stator 12 that keeps the moving part 9 of the actuating means attracted to the fixed part 8 of said actuating means.

Figure 2:
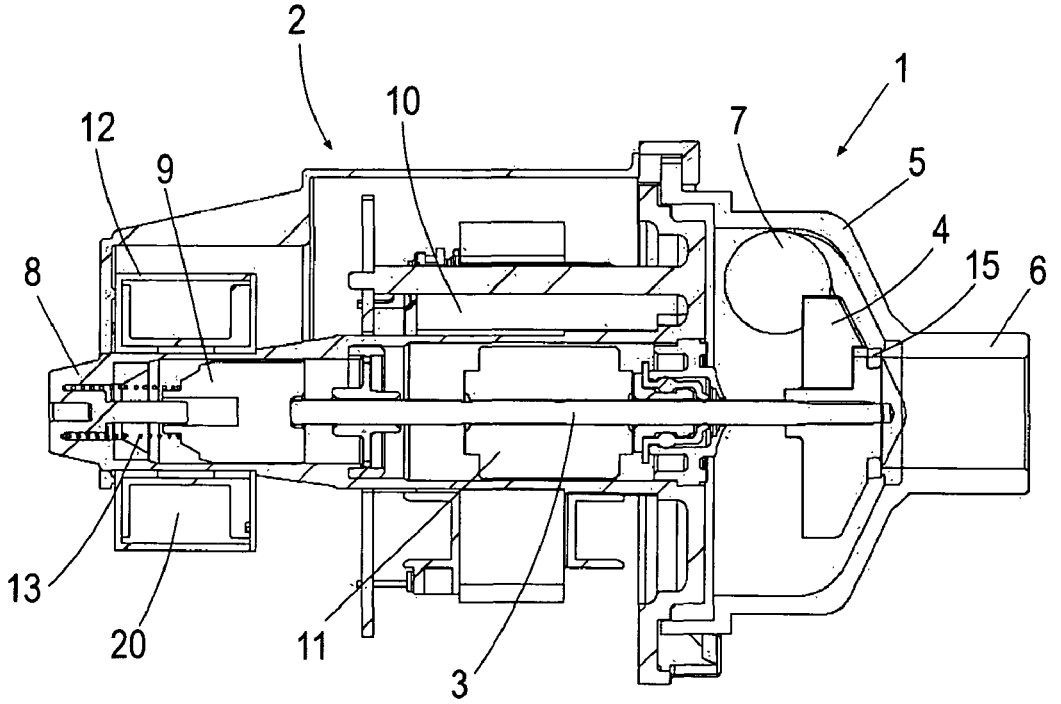
FIG. 2 is a view in section of the embodiment of FIG. 1 with the inlet conduit closed.

In the first embodiment, shown in FIGS. 1 and 2, the recovery means comprise a spring 13. In the second embodiment, shown in FIGS. 3 and 4, the recovery means comprise, in place of a spring 13, a magnet 14 connected to the moving part 9 and a second fixed auxiliary stator 17 that attracts said magnet 14. The other characteristics of both embodiments are the same.

In both embodiments described, the recovery means must generate a force greater than the sum of the force in an opposite direction that the rotor 11 of the motor 2 exerts, the force of the internal frictions of the motor 2, the Venturi suction force and the force necessary to seal the inlet conduit 6. In addition, the force of mechanical attraction generated by the magnetic field created in the auxiliary stator 12 when the motor 2 is being powered, must counteract the force generated by said recovery means.

Figure 3:
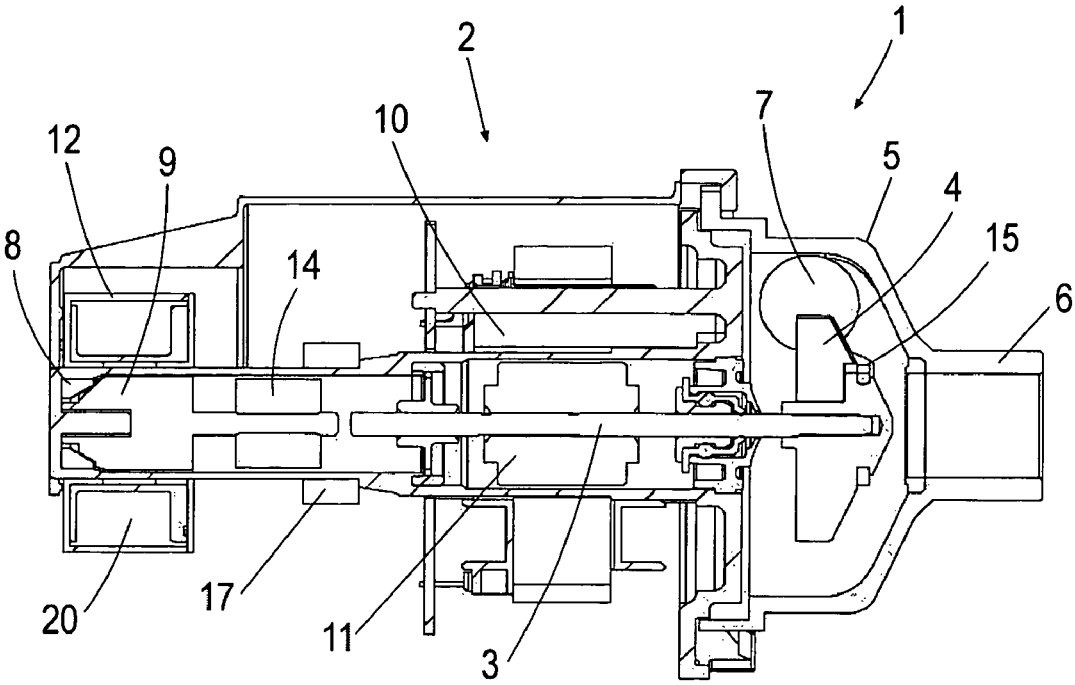
FIG. 3 is a view in section of a second embodiment of the invention with the inlet conduit open.
Figure 4:
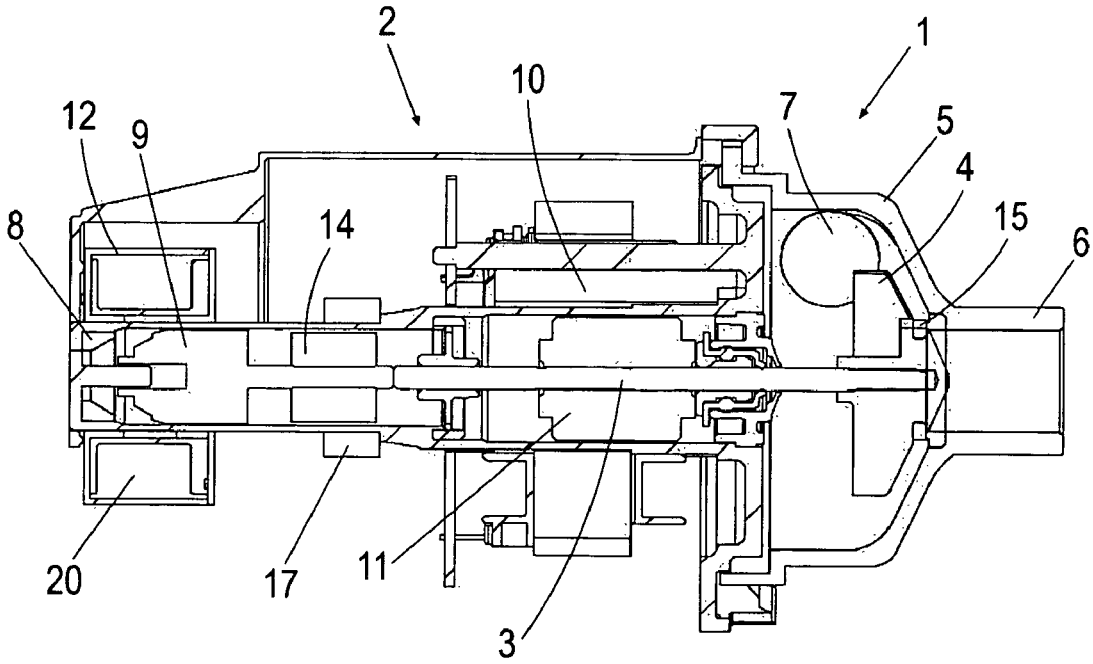
FIG. 4 is a view in section of the embodiment of FIG. 3.

The recovery means act on the moving part 9, which pushes the turning shaft 3 when there is no electrical power. As can be seen in FIGS. 1 and 3, when there is electrical power the moving part 9 is maintained separated from the turning shaft 3. So, in said situation said recovery means are not exerting any mechanical effort on the turning shaft 3 and therefore on the stator 11, i.e. the turning shaft 3 and the stator 11 are physically isolated with respect to the actuating means.

Figure 5:
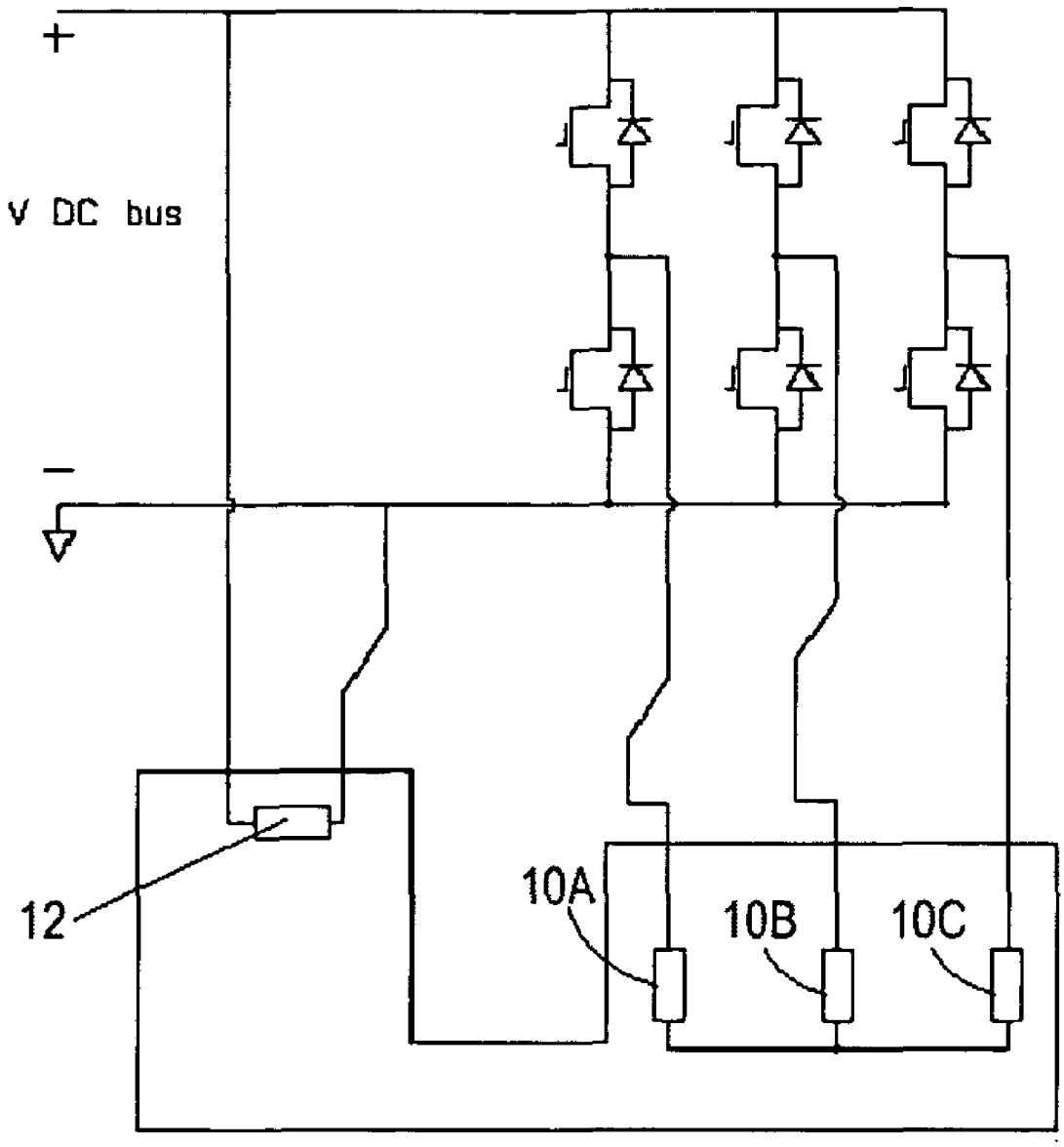
FIG. 5 is an electrical diagram that shows the power supply of the motor for the two embodiments of the invention.

The motor 2 is a permanent-magnet synchronous motor that may comprise any winding distribution. FIG. 5 shows the electrical power for the case of a three-phase motor 2. In the embodiments described, in addition to the phases 10A, 10B and 10C of the stator 10, the auxiliary stator 12 of the actuating means must also be powered, simultaneously, as shown in said FIG. 5.

Finally, in order to guarantee tightness when the impeller 4 blocks the inlet conduit 6, the impeller 4 comprises an elastomer seal 15. In another possible embodiment it is the inlet conduit 6 that comprises an elastomer seal to guarantee tightness.

The invention claimed is:

1. A drain pump for home appliances that comprises a motor with a turning shaft, said motor comprising a fixed stator and a rotor linked to said turning shaft, an impeller connected to said turning shaft, and a hydraulic body in which said impeller is housed, said hydraulic body comprising an inlet conduit and an outlet conduit, the motor comprising actuating means to block one of said conduits when said motor is not being powered, said actuating means axially moving the turning shaft along with the impeller when there is no power running to the motor, said impeller blocking the inlet conduit, the actuating means comprising a fixed part and a moving part, a magnetic field being generated that keeps said fixed part and said moving part connected or next to each other when there is electrical power, and the motor also comprising recovery means that separate the fixed part and the moving part when there is no electrical power, said moving part moving the turning shaft axially, the actuating means also comprising an auxiliary stator with an auxiliary winding, and the fixed part and the moving part of the actuating means operate as magnetic nuclei, the auxiliary winding generating the magnetic field that keeps the moving part connected or next to the fixed part.

2. The drain pump according to claim 1, wherein the moving part is maintained separated from the turning shaft when there is electrical power.

3. The drain pump according to claim 1, wherein the recovery means comprise a spring.

4. The drain pump according to claim 1, wherein the recovery means comprise a magnet.

5. The drain pump according to claim 1, wherein the impeller comprises an elastomer seal to block the inlet conduit hermetically.

6. The drain pump according to claim 1, wherein the inlet conduit comprises an elastomer seal.

7. The drain pump according to claim 1, further comprising a power circuit, wherein power is provided to the auxiliary stator and the auxiliary winding, and the motor by the power circuit.

8. The drain pump according to claim 7, wherein power is simultaneously provided to the auxiliary stator and the auxiliary winding, and the motor by the power circuit.

9. A drain pump for home appliances, the pump comprising:

a motor having a fixed stator, a rotor, and a turning shaft linked to the rotor;

an impeller connected to the turning shaft;

a hydraulic body in which the impeller is housed, the hydraulic body having an inlet conduit and an outlet conduit;

a magnetic field generator for generating a magnetic field;

an actuator having a fixed part and a moving part, said moving part for axially moving the turning shaft along with the impeller, the magnetic field acting on one of the fixed part and the moving part to keep the fixed part and the moving part in a first position when there is electrical power provided to the motor, the first position being a position in which the impeller does not block the inlet conduit; and a recovery element that separates the fixed part and the moving part when there is no electrical power provided to the motor, wherein the recovery element moves the moving part into a second position when there is no electrical power provided to the motor, the second position being a position in which the impeller blocks the inlet conduit.

10. The drain pump according to claim 9, wherein the magnetic field generator is an auxiliary stator and an auxiliary winding, the fixed part and the moving part of the actuator operate as magnetic nuclei, the auxiliary winding generating the magnetic field that keeps the moving part in the first position.

11. The drain pump according to claim 9, wherein the moving part is separated from the turning shaft when there is electrical power provided to the motor.

12. The drain pump according to claim 9, wherein the recovery element is a spring.

13. The drain pump according to claim 9, wherein the recovery element is a magnet.

14. The drain pump according to claim 9, wherein the impeller has a seal that blocks the inlet conduit hermetically when the impeller is in the second position.

15. The drain pump according to claim 9, wherein the inlet conduit has a seal that blocks the inlet conduit hermetically when the impeller is in the second position.

16. The drain pump according to claim 9, further comprising a power circuit, wherein power is provided to the magnetic field generator and the motor by the power circuit.

17. The drain pump according to claim 16, wherein power is simultaneously provided to the magnetic field generator and the motor by the power circuit.

18. The drain pump according to claim 10, further comprising a power circuit, wherein power is provided to the magnetic field generator and the motor by the power circuit.

19. The drain pump according to claim 18, wherein power is simultaneously provided to the magnetic field generator and the motor by the power circuit.

* * * * *